US005277273A

United States Patent [19]

Grimes

[11] Patent Number: 5,277,273

[45] Date of Patent: Jan. 11, 1994

[54] SIMPLIFIED UNITARY TREE CLIMBING DEVICE

[76] Inventor: Donald H. Grimes, 8105 Highway 33 North, Lakeland, Fla. 33809-1705

[21] Appl. No.: 844,527

[22] Filed: Mar. 2, 1992

[51] Int. Cl.[5] ..... E06C 7/08

[52] U.S. Cl. ..... 182/187; 182/116; 182/194

[58] Field of Search ..... 182/187, 133–136; 182/9; 182/194, 182/116; 182/228; 182/206; 182/195; 182/220; 182/216–219; 182/93; 182/178

[56] References Cited

U.S. PATENT DOCUMENTS

| | | | |
|---|---|---|---|
| 305,516 | 9/1884 | Fisher | 182/228 X |
| 2,208,472 | 7/1940 | Richardson | 182/116 X |
| 2,781,961 | 2/1957 | Bendick | 182/216 X |
| 3,630,314 | 12/1971 | Bamburg . | |
| 3,703,939 | 11/1972 | Maxwell | 182/116 X |
| 3,961,686 | 6/1976 | Starkey . | |
| 4,061,202 | 12/1977 | Campbell | 182/187 X |
| 4,263,983 | 4/1981 | Norton . | |
| 4,422,527 | 12/1983 | Schultz et al. . | |
| 4,467,890 | 8/1984 | McCallum et al. . | |
| 4,494,626 | 1/1985 | Ast | 182/106 X |
| 4,560,031 | 12/1985 | Dixon et al. | 182/97 X |
| 4,592,446 | 6/1986 | White . | |
| 4,674,597 | 6/1987 | Humphrey . | |
| 4,991,690 | 2/1991 | Woller | 182/194 X |
| 5,040,635 | 8/1991 | Strickland . | |
| 5,080,193 | 1/1992 | Woof | 182/194 X |
| 5,085,291 | 2/1992 | Narramore | 182/106 |

FOREIGN PATENT DOCUMENTS

| | | |
|---|---|---|
| 911192 | 5/1954 | Fed. Rep. of Germany . |
| 495325 | 6/1954 | Italy . |

*Primary Examiner*—Alvin C. Chin-Shue
*Attorney, Agent, or Firm*—Julian C. Renfro

[57] ABSTRACT

A readily portable device for enabling a vertical columnar structure such as a tree, pole or the like to be climbed without causing damage thereto, this device comprising a pair of rigid, elongate longitudinal members of substantially equal length. These longitudinal members are disposed in a spaced-apart, substantially parallel relationship, with least two step-like members disposed between the longitudinal members, to provide footing to a climber of the vertical structure. A flexible member such as a rope is utilized for tightly encircling the vertical structure, with the flexible member being able to be affixed adjacent the upper end of the device, to form a support therefor. The flexible member is placed in substantial tension at such time as the vertical structure has been encircled and weight is placed on one of the step-like members. The upper end of the device has a structure-contacting portion, with latter portion being brought into a firm, no-slip relationship with the vertical structure at the time of the tensioning of the flexible member, as a consequence of weight being placed upon one of the step-like members.

1 Claim, 5 Drawing Sheets

SIMPLIFIED UNITARY TREE CLIMBING DEVICE

BACKGROUND OF THE INVENTION

The present invention relates generally to the art of climbing trees, utility poles or the like, and more particularly to a device that is simple and more convenient to handle than other such devices, while also providing improved safety during use.

Game hunters of deer, for example, often position themselves in tree stands in trees overlying paths followed by the game through the woods. Mature trees in a forested area typically do not include branches down near the ground so as to allow climbing. Accordingly, hunters frequently have a need for climbing aids that will allow them to get up in a tree along the trunk far enough to reach the lower lying limbs, often some 10 to 15 feet above the ground.

Climbing aids are also needed from time to time by employees of utility companies. For reasons of safety and to avoid potential liability from accidents, utility pole footholds for maintenance personnel typically start some 10 to 12 feet above the ground. This approach is designed to discourage and prevent unauthorized people from climbing up the poles. Of course, utility maintenance personnel need safe and effective climbing aids to reach these footholds in order to make repairs as required; for example, to correct power outages following severe thunderstorms.

Recognizing these needs, a number of devices have been developed in the art for climbing utility poles and trees. Examples of such devices are found in Russian Patent No. 369,914 and Swedish Patent No. 224,286.

The Russian patent discloses a linesman climbing device including a chain that is extended around the utility pole to climbed and a complicated conical gear arrangement for automatically controlling the slack in the chain as the weight of the linesman is applied. The Swedish patent discloses a pole climbing device including a band that is extended around the pole. A gear including a series of lugs that extend through apertures in the band is mounted to the housing to tighten and secure the band in position around the poles for climbing.

While these two devices are effective climbing aids, they are not without their disadvantages. Where an individual is required to climb some 10 to 15 vertical feet before reaching a foothold or tree limb, some of the climbing aids of the type described above may be required to be used in series along the pole or tree trunk. When not in use, the Russian and Swedish devices are not compact, since both include extended lengths of chains and bands, respectively, that are free to become twisted and tangled around each other and other objects during storage and transport to the climbing site. The chains or bands could also become separated and lost from the device, making the device useless.

Devices used in the recent past for climbing trees include a device shown in U.S. Pat. No. 4,263,983 to Norton. That patent describes a portable multi-section ladder including the use of various V-shaped members which may be assembled to any height. Each section may be secured to a tree by straps having a quick release buckle, but this amounts to a device necessarily expensive as well as being heavy and bulky.

The Bamburg et al U.S. Pat. No. 3,630,314 teaches a combination ladder and tree stand, but it is far too large to be carried on a backpack, and only a fixed height can be reached.

The Starkey U.S. Pat. No. 3,961,686 teaches a type of rope ladder to be used to reach a tree stand, but this arrangement manifestly lacks both stability and safety.

The present invention was evolved in an effort to provide an exceedingly light yet sturdy device that can be conveniently carried on a backpack to a remote location, and then readily deployed in a particularly stable configuration that enables an outdoorsman to climb in a safe manner for a considerable distance up the trunk of a tree.

SUMMARY OF THE INVENTION

Provided in accordance with this invention is a readily portable device for enabling a vertical columnar structure such as a tree, pole or the like to be climbed without causing damage thereto, with this device comprising a pair of rigid, elongate longitudinal members of substantially equal length. The longitudinal members are secured in a spaced-apart, substantially parallel relationship at a plurality of spaced locations along their length, with the device having an upper end and a lower end. The device is several times as long as it is wide.

At least two step-like members, but typically three such members are disposed between the longitudinal members in a spaced-apart relationship, to provide footing to a climber of the vertical structure. Flexible means, typically a rope, is provided for tightly encircling the vertical structure, with the ends of the rope being affixed adjacent the upper end of the device, to form a support for the device closely adjacent the vertical structure to be ascended. The rope or other such flexible means is placed in substantial tension at such time as weight is placed on one of the step-like members. Of considerable consequence to my invention is the utilization of a structure-contacting portion adjacent the upper end of my device, preferably the top step of my device. This latter portion is brought into a firm, no-slip relationship with the vertical structure at the time of the tensioning of the flexible means, this occurring as a consequence of weight being placed upon one of the step-like members. By virtue of the unique interaction between the tree-contacting portion of my device, and the bark of the tree upon which the device may be used, considerable stability and therefore safety are offered to the climber.

It is a principal object of this invention to provide a device of lightweight, inexpensive construction enabling a vertical structure such as a tree, pole or the like to be ascended in a safe manner for a considerable distance.

It is another object of my invention to provide a unitary tree climbing device needing no assembly or adjustment before use, that is deployed in a safe and secure manner, and that does not damage the tree or pole upon which it is used.

It is yet another object of my invention to provide a tree climbing device utilizing a unique interaction between the top step of the device, and the bark of the tree upon which the device may be used, such that considerable stability and safety is afforded the climber, with the device not moving to the right or left as weight is placed upon the steps of the device.

It is still another object of my invention to provide an exceedingly light, easily transported tree climbing device of sturdy construction that may be nested with another such device in the interest of compactness, with a pair of such devices enabling the hunter to climb further up a tree than would be possible with only one of such devices.

DETAILED DESCRIPTION

Figure 1:
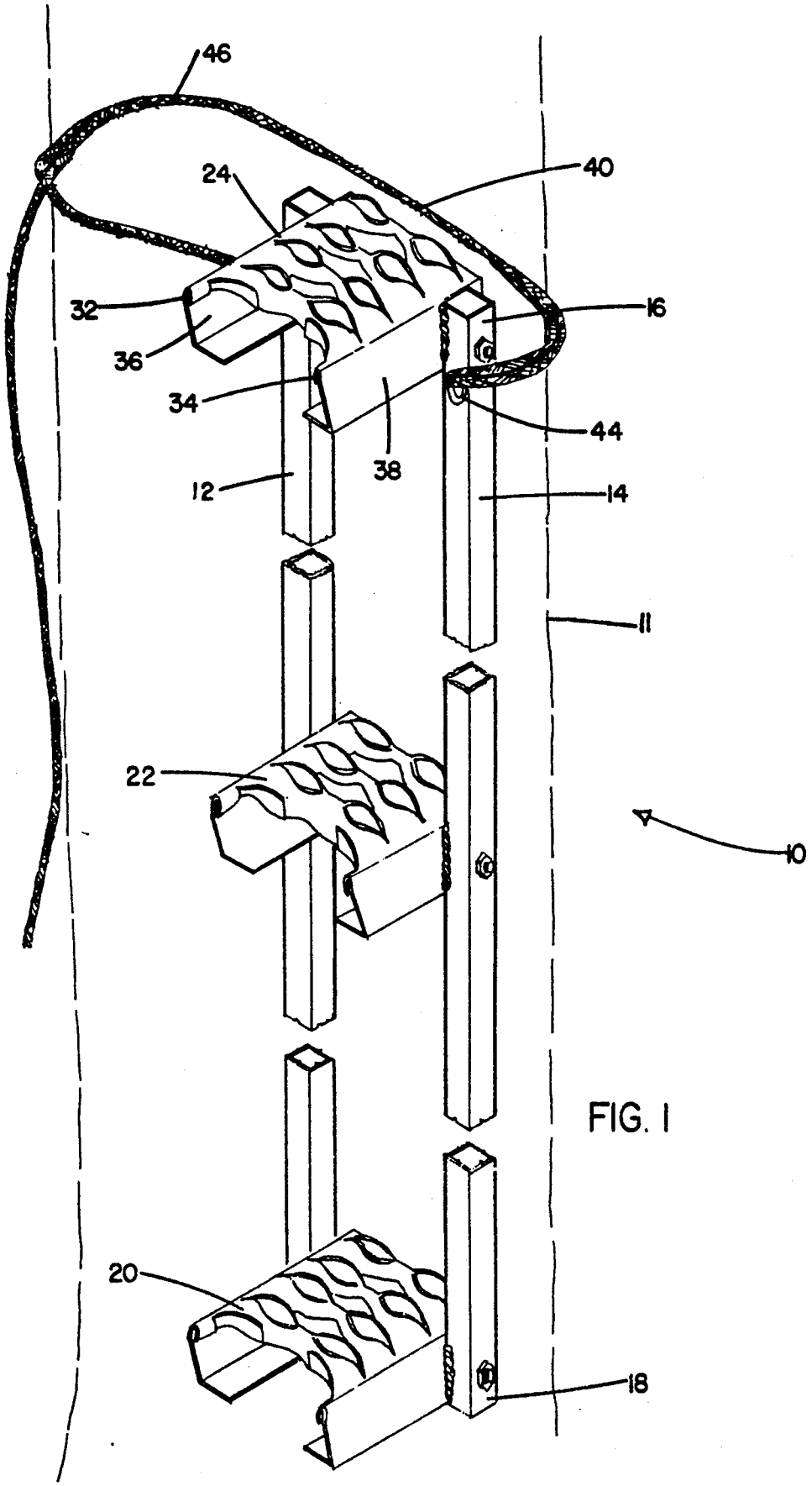
FIG. 1 is a perspective view of a preferred embodiment of novel tree climbing device, which utilizes a flexible means such as a rope for attaching the device to a tree or other vertical structure, which device provides a plurality of steps for the use of the climber.

With initial reference to FIG. 1, it will be seen that I have depicted a readily portable tree climbing device 10 designed to enable a vertical columnar structure 11 such as a tree, pole or the like to be readily climbed without causing damage thereto.

It is to be noted that the device 10 principally comprises a pair of rigid, elongate longitudinal members 12 and 14 of substantially equal length, with the device having an upper end 16 and a lower end 18. The longitudinal members 12 and 14, which are in a vertical or near vertical attitude when in use, may for example be of hollow aluminum sections that are secured in a spaced-apart, substantially parallel relationship at a plurality of spaced locations along their length, such as at top, middle and bottom locations. I am not to be limited to the use of aluminum components, however, for the longitudinal members may be made of steel, stainless steel, or of sturdy non-metallic components in some instances. When longitudinal members of aluminum are used, I have found that square cross-sectional members are preferable to round cross sectional members, for square cross-sectional members have more resistance to undesirable bending. In addition, the use of longitudinal members of square cross section is advantageous from the standpoint of nesting two of my devices together in a compact relationship.

At least two step-like members, but preferably three such members, are disposed between the longitudinal members 12 and 14 in a spaced-apart relationship, to provide footing to a climber of the vertical structure 11. As shown in FIG. 1, I may utilize a lower step-like member 20, a middle step-like member 22, and a top step-like member 24. Each member is wide enough to accept the foot of a hunter that is wearing a boot. The members 20, 22 and 24 are typically of metal, and these members are preferably welded to the longitudinal members. As an alternative, elongate bolts may be utilized, extending side-to-side and through both of the longitudinal members. In this latter event, the members 20, 22 and 24 can rest directly upon such bolts in a stable manner, or such bolts can actually pass through these members.

It will be noted from FIG. 1 that from the standpoint of length or "depth" of the step members 20, 22 and 24, it is not the midpoint of each step that is secured to the longitudinal members 12 and 14. Rather, the steps 20, 22 and 24 are secured to the longitudinal members in an "unbalanced" arrangement in which the rear edges of the steps are secured to the longitudinal members, with the front edges of the steps extending outwardly for several inches in a cantilever manner from the longitudinal members. This is particularly important for reasons of engagement of the forwardmost portions of certain step members with the vertical structure 11, and this point will be discussed at greater length hereinafter.

Figure 2:
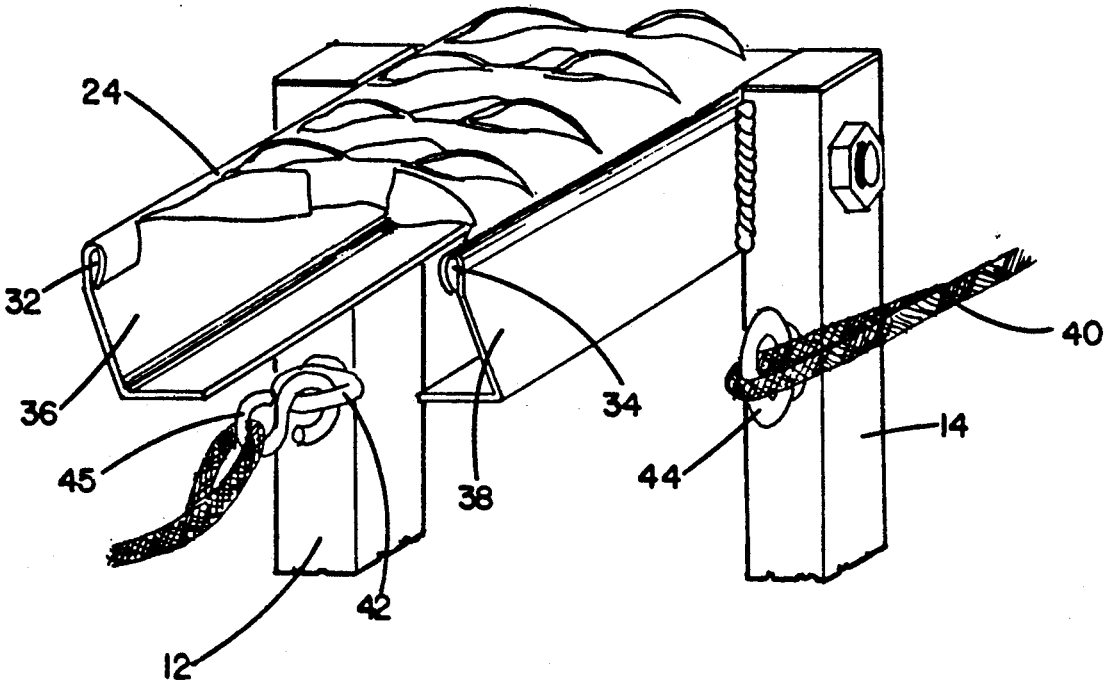
FIG. 2 is a perspective view to a somewhat larger scale of the top step of my tree climbing device, revealing how the forwardmost parts of the step form structure-contacting portions that are brought into firm contact with the tree, to provide stability to the device as well as safety to the climber.

With continued reference to the step members, it is to noted from FIGS. 1 and 2 that I utilize a no-slip upper surface for each step member. By this it is meant that the upper surface of each step member is configured to present considerable friction, such as by having "upwardly upset" portions. Because of this arrangement, it is unlikely that the user of my device will experience his foot slipping off of any of the steps 20, 22 or 24.

It is to be noted that the center step 22 extends less far forwardly from the longitudinal members 12 and 14 than the top and bottom steps, or in other words, the center step is less deep. This is a desirable feature inasmuch as my tree climbing device may be used in a tree that is gnarled or bent, or that has a large knot on its trunk. In such an event, the center step might have undesired contact with the tree and thus cause the bottom step 20 to stand outwardly from the tree for several inches, which might well be disadvantageous to the climber. I avoid this undesirable contact by using a middle step that protrudes less far outwardly than the other two steps of the device.

As will be discussed hereinafter at greater length, I utilize a flexible means 40 such as a rope, cable, seat belt or light chain for tightly holding my tree climbing device 10 to the vertical structure 11, with the flexible means being affixed adjacent the upper end of the device. It is to be understood that the flexible means depicted in the figures of drawing is a rope affixed to an eyelet 44 located at the upper end of the longitudinal member 14, with a hook 45 provided at the opposite end of the rope; note FIG. 2. After the end of the rope has been passed around the vertical structure 11, the hook 45 is to be attached to eyelet 42. At this point, the long slip knot 46 in the rope is pulled tight, so as to cause the outermost portions of the upper step 24 to firmly engage the tree 11. The details of the upper step will now be discussed.

A particularly advantageous aspect of the step configuration I utilize is more apparent from a study of FIG. 2, wherein the upper step 24 is revealed in considerable detail. It will be noted from FIG. 2 that the front part of the top step 24, which is the part farthest from the longitudinal members 12 and 14 and nearest the vertical structure 11, extends for several inches beyond the longitudinal members. Most importantly, the forwardmost portions 32 and 34 of the step 24 ar pointed so as to represent the primary contact the device 10 has with the near surface of the tree, pole or other such vertical structure. I prefer to refer to the pointed portions 32 and 34 as structure-contacting portions, and it will be noted that the front portion of the step between portions 32 and 34 is cut away to avoid contact with the tree.

As will be discussed at greater length hereinafter, the structure-contacting portions 32 and 34 are caused to forcefully engage the tree or other vertical structure at such time as the rope 40 or other flexible means has been fastened tightly around the vertical structure 11, and weight has been placed on one of the steps of the device, typically the bottom step in the first instance. Upon weight being placed on the bottom step 20, the outwardly jutting front portions of step 20, will also likely move into firm contact with the tree or pole.

It is to be observed in FIG. 2 that the upper step 24 is preferably configured to have a box-like structure, involving a top surface two side members 36 and 38 firmly attached to the longitudinal members 12 and 14, and partial bottom surfaces. By way of example, all of these parts of the step can be made from a single piece of sheet metal that has been bent in an appropriate manner. Although the bottom surface of the step could be continuous, in the interests of lightness and economy of manufacture, I typically do not utilize a full bottom surface.

Importantly, the forwardmost portions of the side members 36 and 38 of the step 24 present angled surfaces, visible in FIGS. 1 and 2, in which the bottom portions or edges are closer to the longitudinal members 12 and 14 than are the top portions. In this way I create the previously-mentioned pointed portions 32 and 34 that are intended to come into firm contact with the tree or other vertical structure at the time my device is used. Because the lower parts of the side members 36 and 38 are deliberately not in contact with the tree or pole being climbed, they do not inhibit the structure-contacting portions from making firm contact with the tree or pole. The side surfaces 36 and 38 preferably form a right angle with the top surface of the step.

It should be noted in passing that the steps 20 and 22 may be constructed similarly to step 24 so as to benefit from the economies of mass production, but the specific configuration of the middle and bottom steps is less critical to the proper functioning of my device than is the configuration of the top step. As previously mentioned, the middle step 22 is preferably less deep than the steps 20 and 24, or in other words, its forwardmost portions typically do not extend out as far from the longitudinal members 12 and 14 as do the corresponding portions of the other two steps I am not to be limited to an arrangement in which the structure-contacting portions are integral with the top step, for if desirable, the top step could be separate from the structure-contacting portions.

As to constructional details, when longitudinal members 12 and 14, and the steps 20, 22 and 24 are of aluminum, I prefer to utilize heliarc welding to secure the step-like members in desired locations on the device. Although I a not to be limited to any particular vertical spacing between the step-like members, I have found that most hunters can take a 20 inch step. Therefore, in the preferred embodiment of this invention, the middle step 22 can be located 20 inches above the bottom step 20, and the top step 24 can be located 20 inches above the middle step 22. This of course indicates that a typical overall length for my device can be slightly greater than 40 inches, with the length being, for example, approximately six or seven times as great as its width. I am not to be limited to these numbers, however.

I have already mentioned that my device utilizes flexible means 40 such as a rope, cable, seat belt or light chain for tightly holding it to the vertical structure 11, with the flexible means being affixed adjacent the upper end of the device. In the event the means 40 is a rope affixed to eyelet 44 located at the upper end of the longitudinal member 14, a hook 45 is provided at the opposite end of the rope. After the end of the rope has been passed around the vertical structure 11, the hook 45 is to be attached to eyelet 42, in the manner visible in FIG. 2.

A preferred way of accomplishing the securing the rope tightly around the tree or other vertical structure is by the utilization of a long slip knot 46 in the nature of a Chinese finger puzzle, which is relatively easy to create in a rope of braided man-made material, such as a suitable plastic. This type of knot permits the rope to be brought into a very tight relationship to the vertical structure, with this degree of tightness then being retained by the degree of friction present in the knot 46. At such time as the tree climbing device is later to be removed from the vertical structure, the knot 46 can be loosened by removing tension from the rope and then using the fingers to loosen the knot.

It is important to note that the rope 40 is necessarily placed in substantial tension at such time as weight is placed on one of the step-like members, such as lower step 20. As a result of the rope being placed in considerable tension, the upper end of the device, and more particularly the pointed portions 32 and 34 of the top step 24, are caused to dig into the bark of a tree or the outer surface of a pole in a way providing considerable stability to the device 10, such that the device does not shift to the right or to the left when weight is put on the step.

It is thus to be seen that a very important aspect of this invention involves the interaction of the structure-contacting portions 32 and 34 located at the upper end of the device, with the tree or pole to be climbed. As previously explained, the structure-contacting portions 32 and 34 may be created as an integral part of the upper step 24, which portions are brought into a tight, no-slip relationship with the vertical structure at the time of the tensioning of the flexible means 40. Additional tensioning of the flexible means is of course brought about by the user's weight being placed upon one of the step-like members.

This part of my invention may therefore be summarized by pointing out that upon weight being placed upon one of the steps, the rope 40 becomes more and more taut, thus causing the pointed portions 32 and 34 to dig to some extent into the outer surface of the tree or pole. Because the lower portions of the side members 36 and 38 are cut away, they do not interfere with the structure-contacting portions digging to some extent into the bark of the tree, or the outer surface of the pole. In this way a high degree of stability is afforded the climber.

It must be recognized that the effect of the opposite ends of the flexible means 40 being affixed to the tops of the longitudinal members 12 and 14 causes a force endeavoring to spread the longitudinal members apart at such time as the flexible means has been passed around a tree of somewhat large diameter, and weight then placed on one of the steps of the tree climbing device 10. This force tending to spread the tops of the longitudinal members apart is of no particular consequence when steps of rugged construction, such as illustrated in FIGS. 1 and 2, are utilized. However, if for reasons of economy, less sturdy steps are employed, it may well be desirable to secure a reinforcing member extending laterally between the top of member 12 and the top of member 14, to prevent these members from spreading apart during use.

Figure 3:
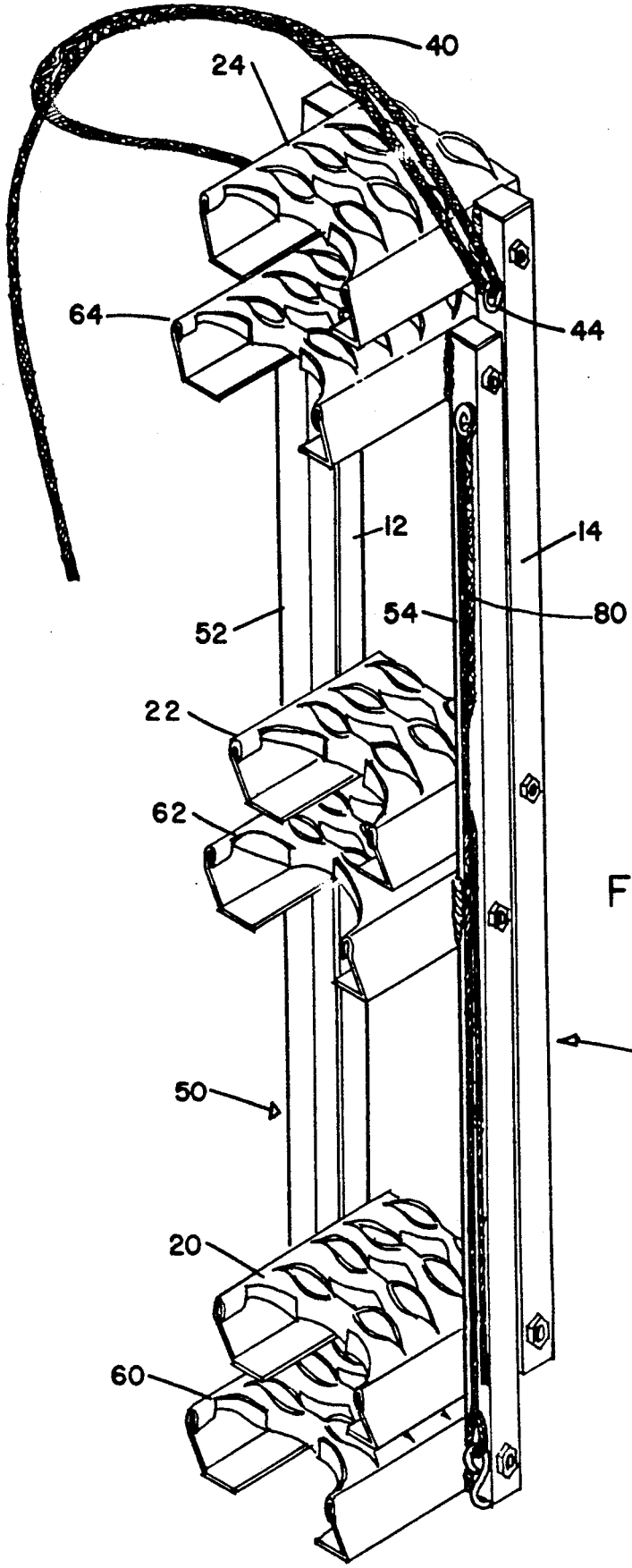
FIG. 3 is a perspective view similar to FIG. 1, but showing how two of my devices can be placed in a nested relationship in the interests of compactness and portability.

With reference to FIG. 3, it will be seen that I have there shown a pair of my tree climbing devices in nested relation, this being the device 10 upon which the essentially identical device 50 has been placed in interfitting relationship. The fact that these devices can be nested is important from the standpoint of transportability and storage, for obviously a nested pair of these devices will take up considerably less space in a vehicle or storage location than would a pair of devices that could not be nested.

All of the step members I utilize are ideally of identical dimensions, so the spacing between the longitudinal members 12 and 14 of device 10 will be substantially identical to the distance between the longitudinal members 52 and 54 of the device 50. Because of this consistency, it is relatively easy to nest either device on top of the other such device.

When two of my devices have been nested in the manner depicted in FIG. 3, a desirable amount of friction will be present between the vertical outer edges of the steps of the rear device 10 of the nested pair, and the inner edges of the longitudinal members of the front device 50, with this serving to hold the two devices together in a highly desirable relationship. This is to say, when the pair of devices is nested in the manner illustrated in FIG. 3, the steps 20 and 22 of the device 10 provide the desirable amount of friction removably securing the devices 10 and 50 together. It should now be more apparent why I prefer to use longitudinal members 12 and 14 of square cross section rather than round cross section, for a more desirable amount of friction will exist between the side edges 36 and 38 of a step and the longitudinal members of the adjacent device in the event such longitudinal members are of square cross section.

When the devices are to be used, it is but a simple matter to pull them apart.

Figure 4:
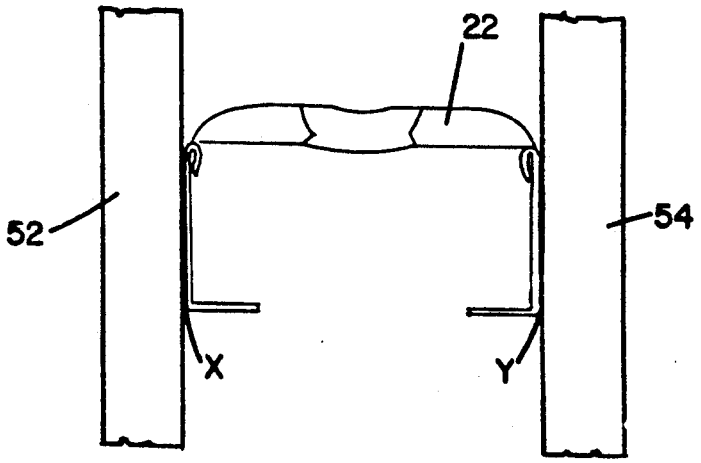
FIG. 4 is a view revealing how one of the steps of the rear device in FIG. 3 can extend closely between the upright or longitudinal members of the front device, thus providing a desirable amount of friction serving to hold the devices in the nested relationship.

In FIG. 4 I have shown a typical relationship between one of the steps of the rear device 10, and the longitudinal members of the forward device 50, as these devices were depicted in FIG. 3. In FIG. 4 I have shown the step 22 of the rear device 10 residing closely between the longitudinal members 52 and 54 of the forward device 50, with a desirable amount of friction being present at locations X and Y, between the vertically-disposed outer side edges of the step 22, and the adjacent, inner surfaces of the longitudinal members 52 and 54.

Figure 5:
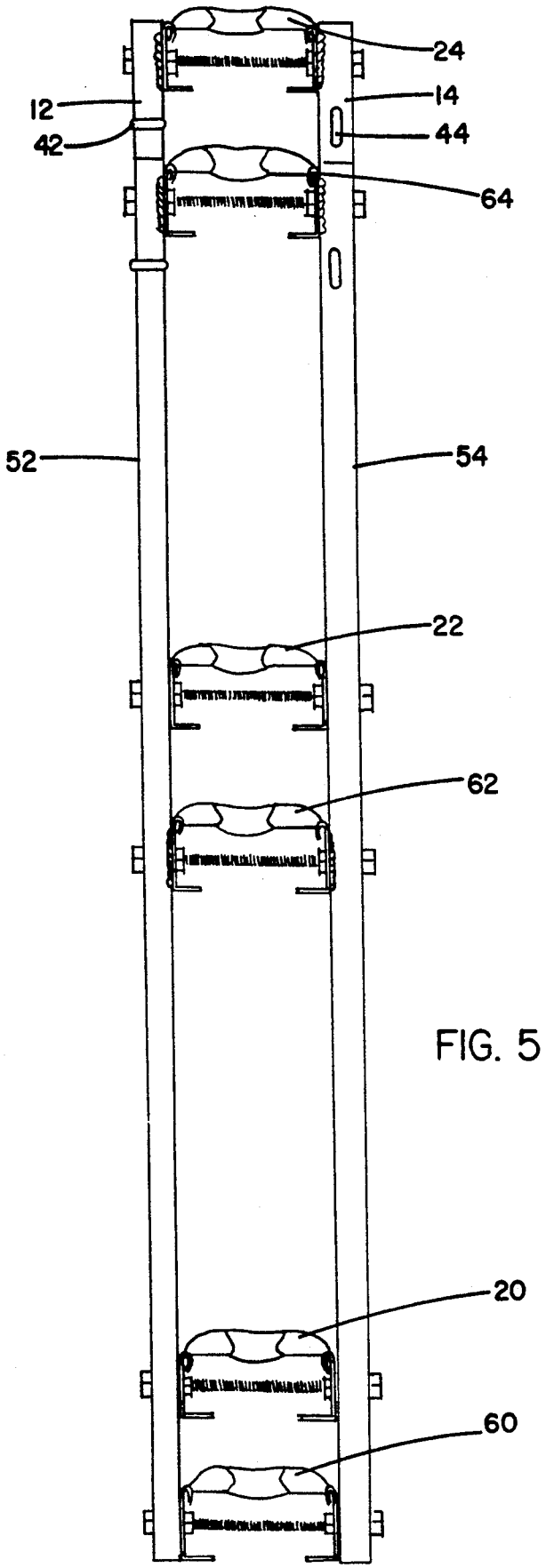
FIG. 5 is view of a nested pair of my devices, in the position in which they can be readily carried on the backpack of a hunter or other outdoorsman, with the ropes not being shown in this figure for reasons of clarity.

In FIG. 5 I have shown the attitude in which a nested pair of my tree climbing devices typically reside at the time they are being carried on the back of a hunter or other outdoorsman. Although these devices could be carried directly on the back of the hunter, if they are attached to the rear part of the hunter's backpack, such as by bungee cords or the like, this will provide a desirable amount of spacing as will make it less likely for the back of the hunter's head to come into undesired contact with the upper portion of the devices as he hikes through the woods and finds it necessary from time to time to climb over objects and move through dense brush.

Figure 6:
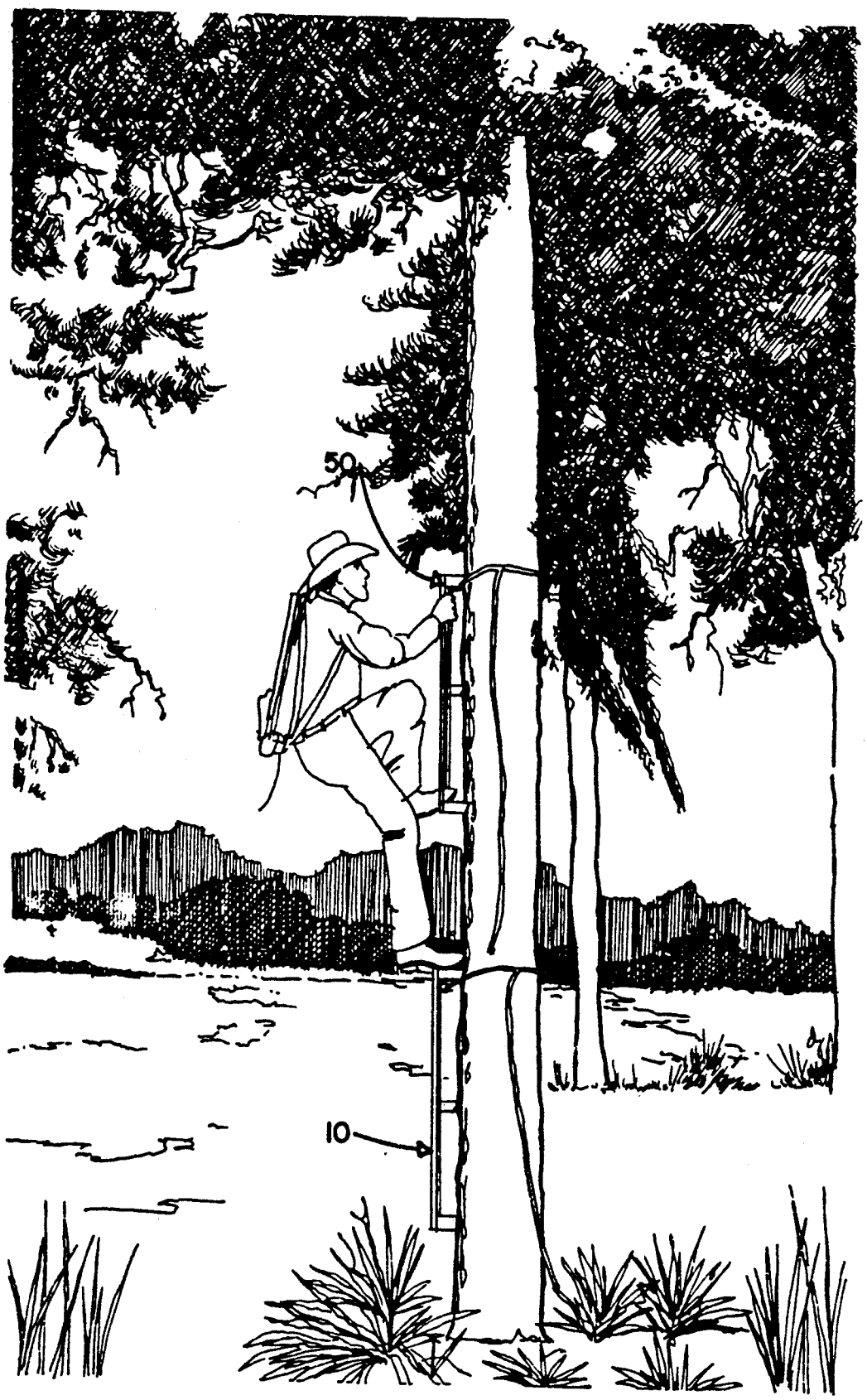
FIG. 6 is a view indicating how a pair of my devices are utilized by an outdoorsman endeavoring to climb a tree having no low branches, with one of my devices typically being utilized one step above the bottom of the tree, and the other device typically being utilized one step above the top of the first device.

FIG. 6 is a view indicating how a pair of my devices are utilized by an outdoorsman endeavoring to climb a tree having no low branches, with one of my devices typically being utilized approximately one step above the bottom of the tree. The other device is typically utilized one step above the top of the first device, so that the outdoorsman can step from the lower device directly onto the upper device. In this manner, a reasonably tall outdoorsman can readily reach branches as high as fourteen feet off the ground.

It can now be seen that I have provided highly effective tree climbing devices that can be manufactured at relatively low cost, that are safe in use, and that can be nested together in the interests of portability and compactness.

I claim:

1. A readily portable device for enabling a vertical columnar structure such as a tree, pole or the like to be climbed without causing damage thereto, said device comprising a pair of elongate, essentially straight longitudinal members of substantially equal length, said longitudinal members being disposed in a spaced-apart, substantially parallel relationship, with said device having an upper end, at least two step-like members disposed between said longitudinal members, to provide footing to a climber of the vertical structure, flexible means for tightly encircling the vertical structure, with said flexible means being able to be affixed adjacent said upper end of said device, to form a support for said device, said flexible means being placed in substantial tension at such time as the vertical structure has been encircled and weight is placed on one of said step-like members, said upper end of said device having a structure-contacting portion, said structure-contacting portion involving a spaced pair of pointed members provided for digging into the surface of the vertical structure, latter pointed members being brought into a firm, no-slip, stability-producing relationship with the vertical structure at the time of the tensioning of said flexible means, as a consequence of weight being placed upon one of said step-like members, said at least two step-like members protruding in a first direction beyond said longitudinal members for a distance sufficient to extend between and frictionally engage the longitudinal members of a substantially identical device placed alongside and in a parallel relationship with the first device, thus to enable a pair of such devices to be readily nested together in the interests of compactness, protruding edge portions of said step-like members including an uppermost one of said step-like members of one device fitting closely between the longitudinal members of a like device, thus to provide a desirable amount of friction, resulting in the two devices being nested together, wherein said structure-contacting portion involving the spaced pair of pointed members is a part of the uppermost step-like member.

* * * * *